US011162758B1

(12) United States Patent
Lee et al.

(10) Patent No.: US 11,162,758 B1
(45) Date of Patent: Nov. 2, 2021

(54) ADJUSTABLE MULTI-ANGLE GRIP FOR FIREARMS

(71) Applicant: Strike Industries, Inc., Santa Ana, CA (US)

(72) Inventors: Shanyao Lee, Santa Ana, CA (US); Shih-Ting Hung, Taoyuan (TW)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 17/164,784

(22) Filed: Feb. 1, 2021

(51) Int. Cl.
*F41C 23/10* (2006.01)

(52) U.S. Cl.
CPC ..... *F41C 23/10* (2013.01)

(58) Field of Classification Search
CPC ..... F41C 23/10; F41C 23/04; F41C 23/14; F41C 23/16
See application file for complete search history.

(56) References Cited

U.S. PATENT DOCUMENTS

| | | | | |
|---|---|---|---|---|
| 8,857,094 | B2 | 10/2014 | Michel | |
| 9,383,162 | B2 | 7/2016 | Spykerman et al. | |
| 9,599,429 | B1 | 3/2017 | Davis | |
| 10,415,926 | B2 | 9/2019 | Schroeder | |
| 11,112,208 | B1 * | 9/2021 | Mantas | F41C 23/04 |
| 2012/0272557 | A1 * | 11/2012 | Yan | F41C 23/16 42/69.01 |
| 2021/0164754 | A1 * | 6/2021 | Rice | F41C 23/16 |

* cited by examiner

*Primary Examiner* — J. Woodrow Eldred
(74) *Attorney, Agent, or Firm* — Han IP PLLC; Andy M. Han

(57) ABSTRACT

A device implementable on a firearm includes an adjustable multi-angle grip. The grip includes an upper portion and a lower portion. The upper portion is configured to be coupled to a receiver portion of the firearm. The lower portion is pivotably coupled to the upper portion via a hinge on a front side of the grip such that an angle between a longitudinal axis of the lower portion and a longitudinal axis of a barrel of the firearm is variable.

20 Claims, 5 Drawing Sheets

ADJUSTABLE MULTI-ANGLE GRIP FOR FIREARMS

TECHNICAL FIELD

The present disclosure is generally related to firearm accessories and, more particularly, to an adjustable multi-angle grip for firearms.

BACKGROUND

Unless otherwise indicated herein, approaches described in this section are not prior art to the claims listed below and are not admitted as prior art by inclusion in this section.

In the context of firearms, a grip is a portion of the firearm that allows a shooter or a user of the firearm to hold and grab onto so that the user can carry, operate or otherwise maneuver the firearm. On certain types of firearms such as rifles, carbines and pistols based on the AR, AK or other platforms, the grip is also known as a "pistol grip" as it is a distinctly protruded handle underneath the lower receiver of the firearm to be held by the user. However, on most firearms that come with a pistol grip, the pistol grip is often fixed in place. As such, there the user would not be able to adjust an angle of the grip to suite the user's particular needs (e.g., for ergonomic purposes). There is, therefore, a need for a solution that enables users to adjust the angle of the grip on their firearms.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose various designs of an adjustable multi-angle grip for firearms. It is believed that the proposed design can avoid or otherwise minimize aforementioned issues associated with conventional pistol grips on firearms.

In one aspect, a device implementable on a firearm (e.g., one that is based on the AR platform, AK platform or another platform (such as the CZ EVO)) may include an adjustable multi-angle grip. The grip may include an upper portion and a lower portion. The upper portion may be configured to be coupled to a receiver portion of the firearm. The lower portion may be pivotably coupled to the upper portion via a hinge on a front side of the grip such that an angle between a longitudinal axis of the lower portion and a longitudinal axis of a barrel of the firearm is variable.

In another aspect, a device implementable on a firearm (e.g., one that is based on the AR platform, AK platform or another platform (such as the CZ EVO)) may include an adjustable multi-angle grip. The grip may include an upper portion, a lower portion and a ball head screw (or a cylinder head screw). The upper portion may be configured to be coupled to a receiver portion of the firearm. The lower portion may be pivotably coupled to the upper portion via a hinge on a front side of the grip adjacent a trigger guard of the firearm. The ball head screw (or cylinder head screw) may be insertable into a threaded holder of the lower portion by traversing through the upper portion with a ball joint of the ball head screw (or cylinder head of the cylinder head screw) received in a socket of the upper portion.

In yet another aspect, a device implementable on a firearm (e.g., one that is based on the AR platform, AK platform or another platform (such as the CZ EVO)) may include an adjustable multi-angle grip. The grip may include an upper portion, a lower portion and an angle adjustment mechanism. The upper portion may be configured to be coupled to a receiver portion of the firearm. The lower portion may be pivotably coupled to the upper portion via a hinge on a front side of the grip and adjacent a trigger guard of the firearm such that an angle between a longitudinal axis of the lower portion and a longitudinal axis of a barrel of the firearm is variable. The angle adjustment mechanism may be engaged with the upper portion and the lower portion such that a movement of the angle adjustment mechanism relative to the lower portion along the longitudinal axis of the lower portion may cause the angle between the longitudinal axis of the lower portion and the longitudinal axis of the barrel of the firearm to vary.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
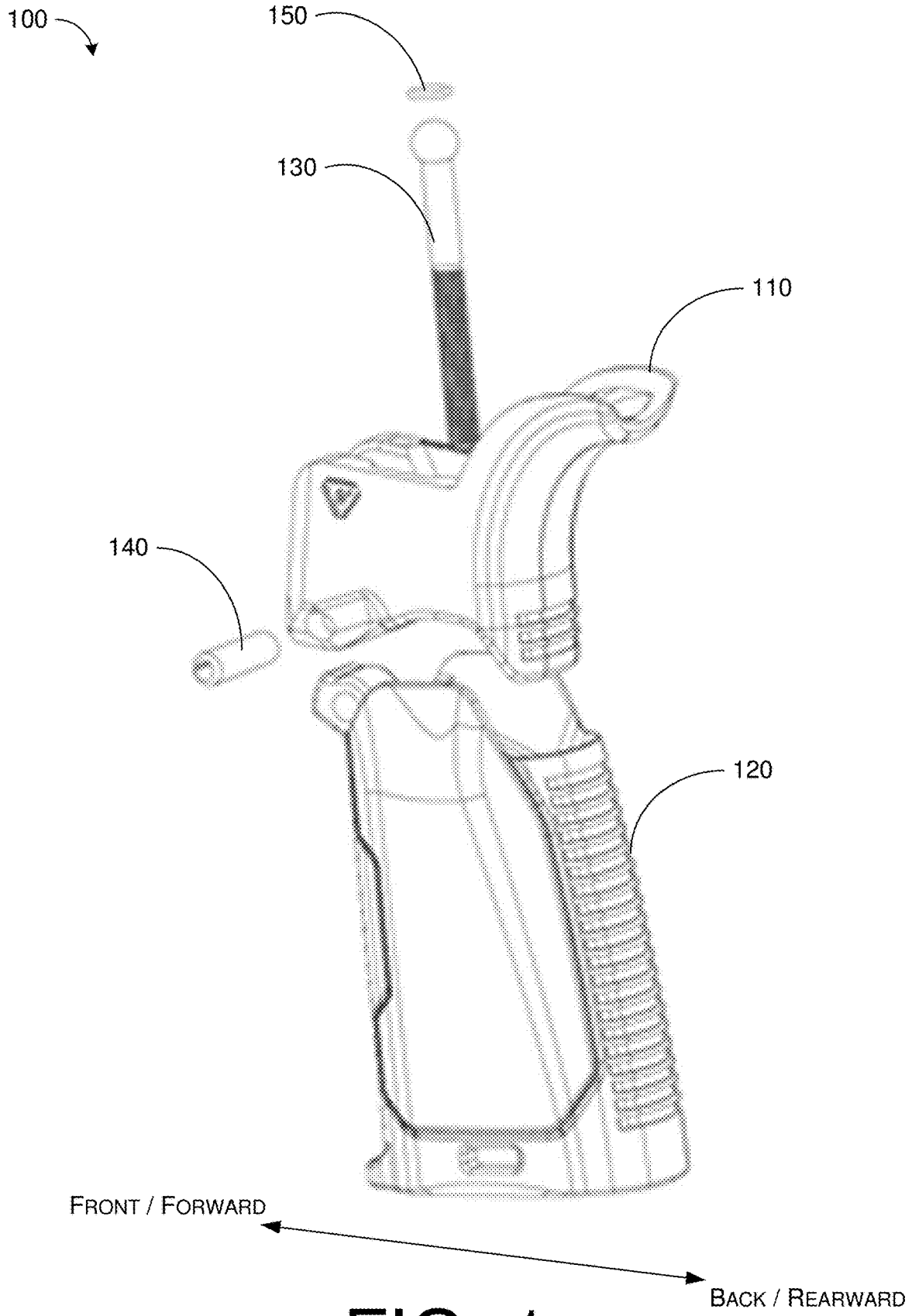
FIG. 1 is a diagram of a perspective view of a device in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Figure 2:
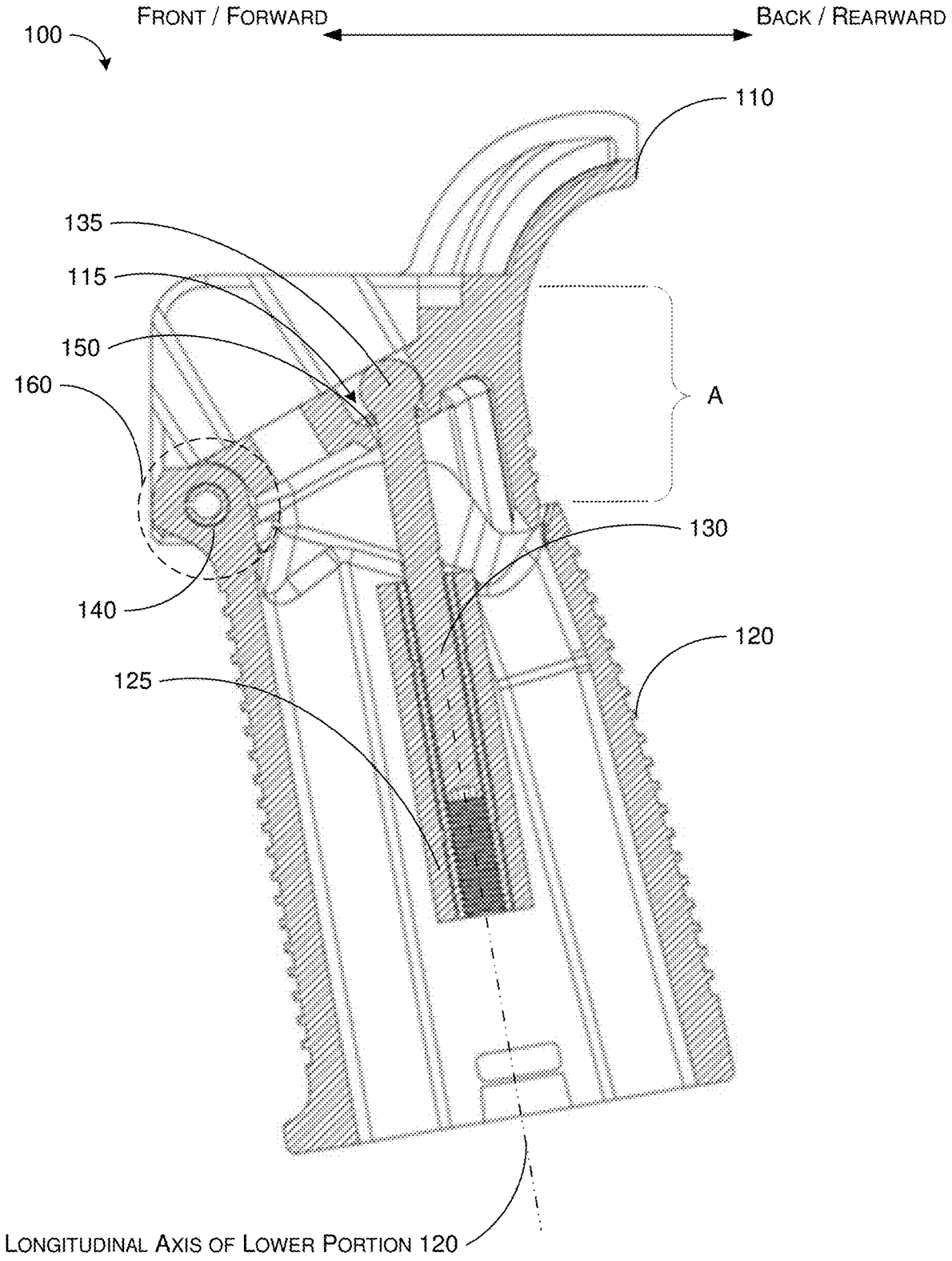
FIG. 2 is a diagram of a cross-sectional view of a device in accordance with an implementation of the present disclosure.
Figure 3:
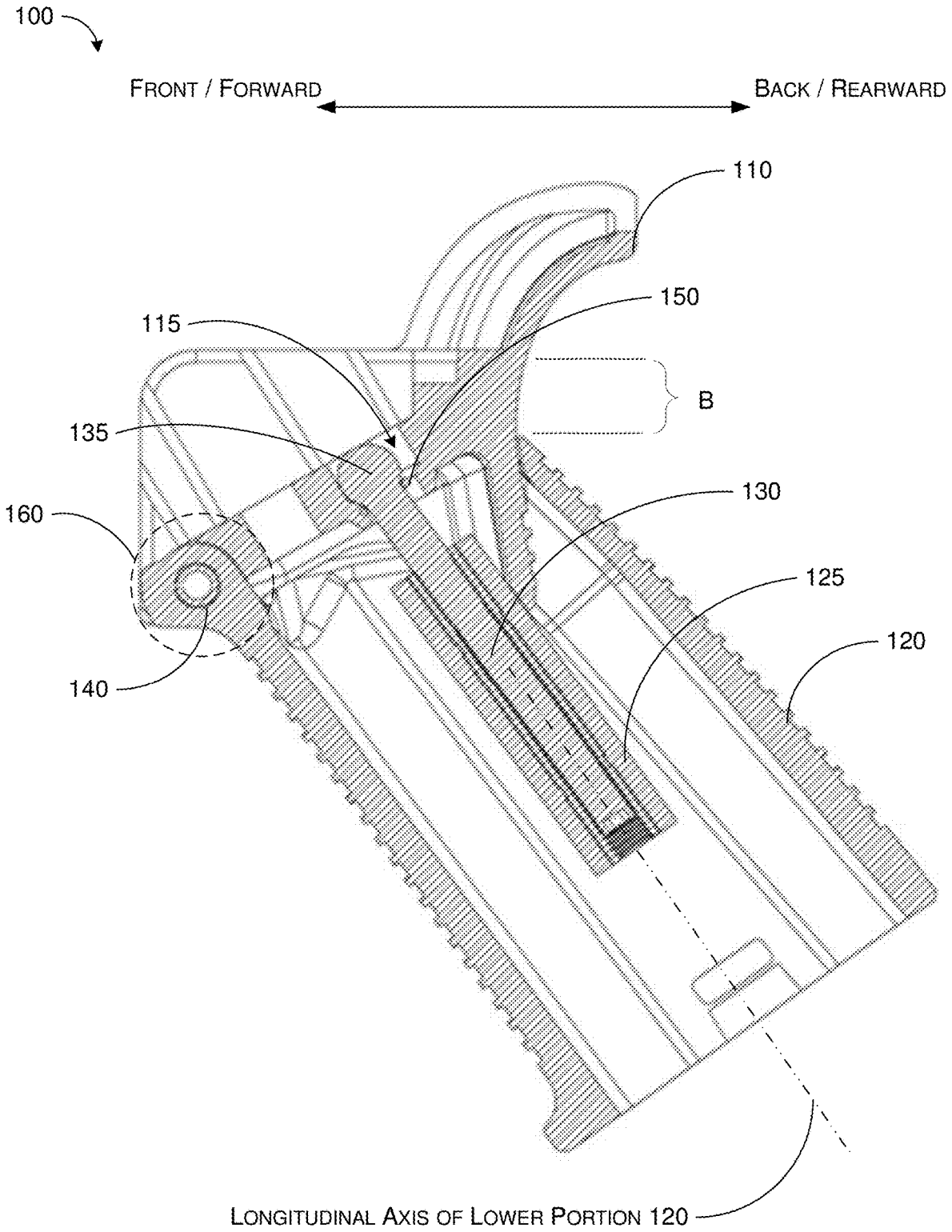
FIG. 3 is a diagram of a cross-sectional view of a device in accordance with an implementation of the present disclosure.
Figure 4:
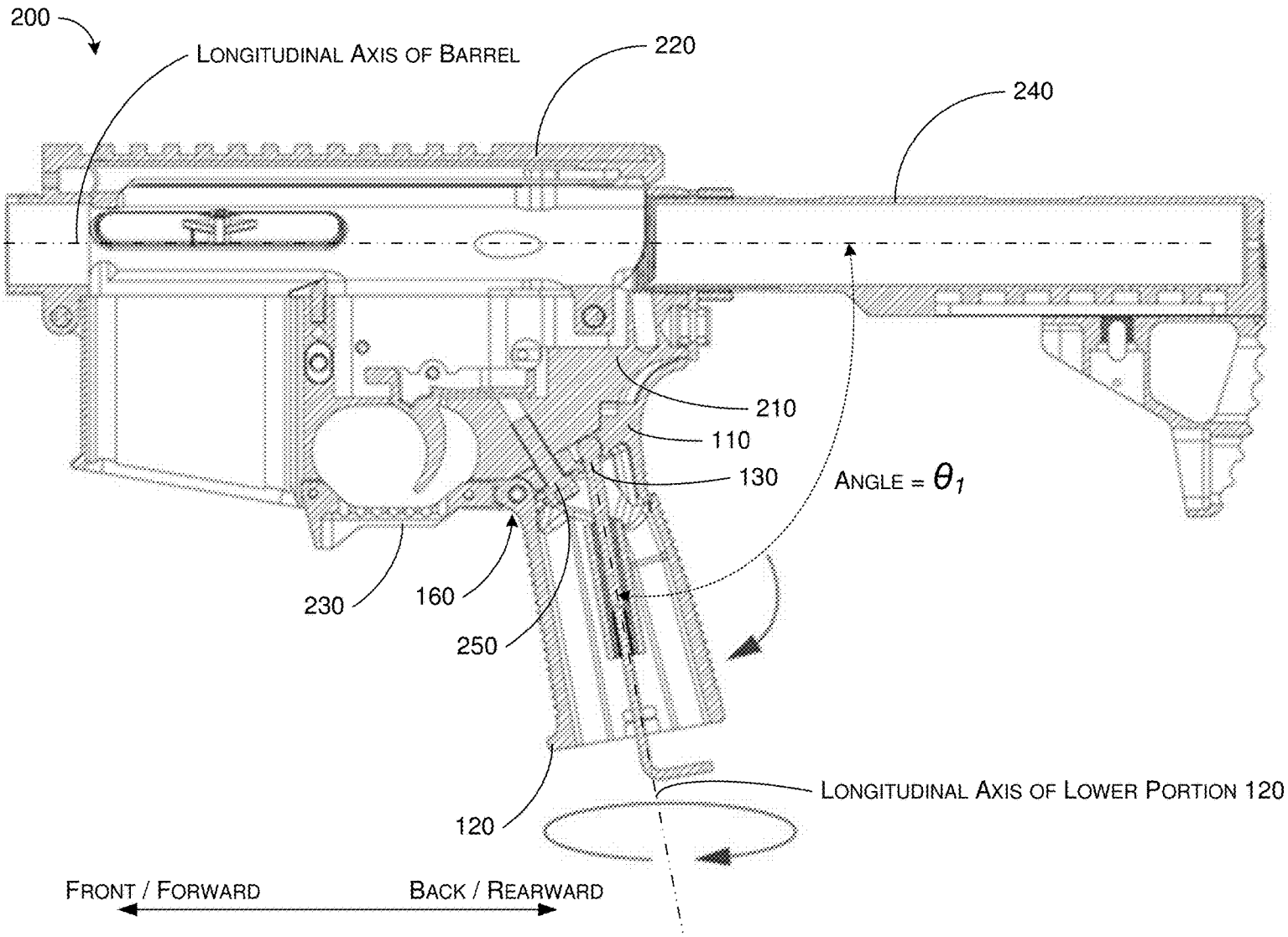
FIG. 4 is a diagram of a cross-sectional view of a portion of a firearm with a device in accordance with an implementation of the present disclosure.
Figure 5:
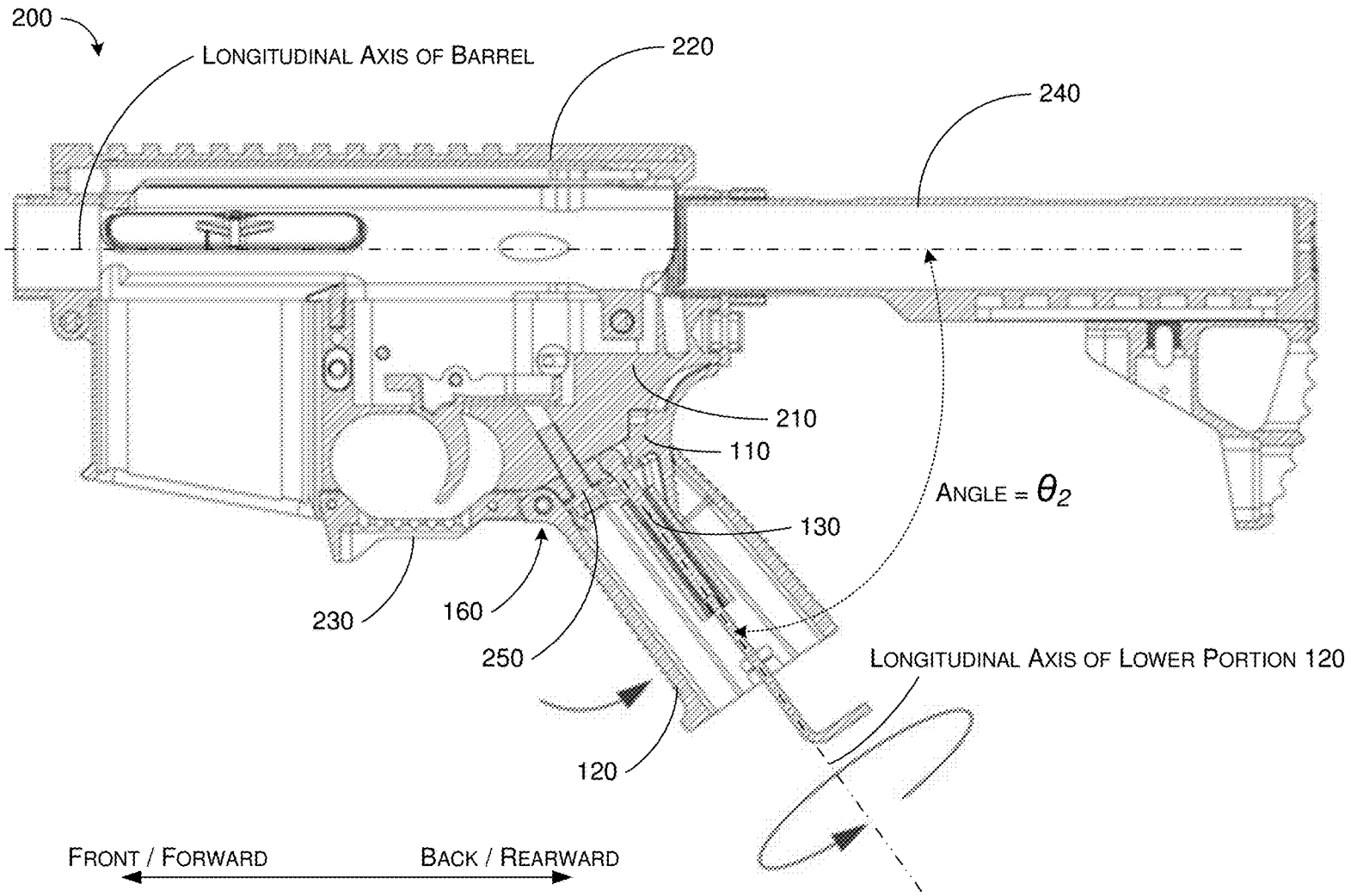
FIG. 5 is a diagram of a cross-sectional view of a portion of a firearm with a device in accordance with an implementation of the present disclosure.

Each of FIG. 1-FIG. 5 illustrates a respective view and/or a cross-sectional portion of a device 100 in accordance with an implementation of the present disclosure. Device 100 may be implemented on (e.g., attached to, installed on, or mounted on) a firearm such as a rife, carbine, shotgun or pistol. Specifically, device 100 may be installed on a firearm 200 (e.g., a firearm based on the AR platform, AK platform or another platform (such as the CZ EVO)) as a pistol grip, as shown in FIG. 4 and FIG. 5. As shown in FIG. 4 and FIG. 5, firearm 200 may include, among other components not shown (such as a barrel), a lower receiver 210, an upper receiver 220, a trigger guard 230 and a buffer tube 240. It is noteworthy that, although firearm 200 depicted in FIG. 4 and FIG. 5 may resemble certain components of a firearm based on the AR platform, firearm 200 may be based on the AK platform or another platform such as the CZ EVO. In other words, the scope of the present disclosure is not limited to firearms based on the AR platform.

Referring to FIG. 1-FIG. 5, device 100 may include an upper portion 110, a lower portion 120, and an angle adjustment mechanism, which may include a ball head screw or cylinder head screw 130. For simplicity and not to obscure the figures, in FIG. 1-FIG. 5 a ball head screw is shown, although it is understood that a different type of angle adjustment mechanism (e.g., a cylinder head screw/bolt, a hex socket bolt screw or another type of screw or bolt) may be utilized in place of the ball head screw. Additionally, device 100 may include and a hinge pin 140. Optionally, device 100 may also include an O-ring 150. Upper portion 110 may be configured to be coupled to a receiver portion of the firearm (e.g., lower receiver of a rifle, carbine or pistol based on the AR platform, AK platform or another platform (such as the CZ EVO)). Lower receiver 120 may be pivotably coupled to upper portion 110 via a hinge 160 formed with hinge pin 140 on a front side of the grip of device 100. For instance, as shown in FIG. 4 and FIG. 5, as lower portion 120 pivots around hinge 10 with respect to upper portion 110 when device 100 is installed on a firearm 200 such that an angle between a longitudinal axis of lower portion 120 and a longitudinal axis of a barrel of firearm 200 is variable (e.g., between $\theta_1$ and $\theta_2$). Furthermore, as shown in FIG. 4 and FIG. 5, hinge 160 may be adjacent (e.g., immediately behind) trigger guard 230 of firearm 200 when device 100 is installed on firearm 200.

Under a proposed design, the angle adjustment mechanism may be engaged with upper portion 110 and lower portion 120 such that a movement of the angle adjustment mechanism relative to lower portion 120 along the longitudinal axis of lower portion 120 may cause the angle between the longitudinal axis of lower portion 120 and the longitudinal axis of the barrel of firearm 200 to vary. Referring to FIG. 2 and FIG. 3, angle adjustment mechanism may include a ball head screw or cylinder head screw 130, which may be insertable into a threaded holder 125 of lower portion 120 by traversing through upper portion 110 with a ball joint or cylinder head 135 of ball head screw or cylinder head screw 130 received in a socket 115 of upper portion 110 (and with rubber O-ring 150 disposed between ball joint or cylinder head 135 and an interior surface of socket 115 of upper portion 110 to help reduce friction). Under a proposed design, threaded holder 125 of lower portion 120 may include a threaded through hole along the longitudinal axis of lower portion 120. Thus, as ball head screw or cylinder head screw 130 moves further inward or out of threaded holder 125 of lower receiver 120 along the longitudinal axis of lower receiver 120, the angle between the longitudinal axis of lower portion 120 and the longitudinal axis of the barrel of firearm 200 may vary. For instance, as shown in FIG. 2 and FIG. 4, as ball head screw or cylinder head screw 130 moves out of threaded holder 125 of lower receiver 120 along the longitudinal axis of lower receiver 120 to a certain extent, the angle between the longitudinal axis of lower portion 120 and the longitudinal axis of the barrel of firearm 200 may be $\theta_1$. Similarly, as shown in FIG. 3 and FIG. 5, as ball head screw or cylinder head screw 130 moves inward in threaded holder 125 of lower receiver 120 along the longitudinal axis of lower receiver 120 to a certain extent, the angle between the longitudinal axis of lower portion 120 and the longitudinal axis of the barrel of firearm 200 may be $\theta_2$, with $\theta_2<\theta_1$.

Under a proposed design, the angle adjustment mechanism may be rotated around the longitudinal axis of lower receiver 120 to cause the angle between the longitudinal axis of lower portion 120 and the longitudinal axis of the barrel of firearm 200 to vary. For instance, referring to FIG. 3 and FIG. 5, in response to the angle adjustment mechanism being rotated around the longitudinal axis of lower portion 120 in a first direction (e.g., counterclockwise when looking up into lower portion 120 from the bottom side thereof), the angle between the longitudinal axis of lower portion 120 and the longitudinal axis of the barrel of firearm 200 may decrease. Moreover, referring to FIG. 2 and FIG. 4, in response to the angle adjustment mechanism being rotated around the longitudinal axis of the lower portion in a second direction opposite the first direction (e.g., clockwise when looking up into lower portion 120 from the bottom side thereof), the angle between the longitudinal axis of lower portion 120 and the longitudinal axis of the barrel of firearm 200 may increase. Accordingly, in operation: (a) in response to ball head screw or cylinder head screw 130 being tightened and further received in threaded holder 125 of lower portion 120, lower portion 120 may pivot in a first direction (e.g., to change from FIG. 2 to FIG. 3 or to change from FIG. 4 to FIG. 5) to expose less of a back side of upper portion 110 (e.g., by an amount B as shown in FIG. 3), and (b) in response to ball head screw or cylinder head screw 130 being loosened and less received in threaded holder 125 of lower portion 120, lower portion 120 may pivot in a second direction (e.g., to change from FIG. 3 to FIG. 2 or to change from FIG. 5 to FIG. 4) to expose more of the back side of upper portion 110 (e.g., by an amount A as shown in FIG. 2, with A>B). It is noteworthy that, although examples described herein pertain to the angle adjustment mechanism including a ball head screw or cylinder head screw, in various implementations, the angle adjustment mechanism may include a different type of screw or bolt that can provide the same or similar functionality as the ball head screw or cylinder head screw 130 described herein. In other words, the scope of the present disclosure is not limited to the angle adjustment mechanism being a ball head screw or cylinder head screw.

Under a proposed design, when device 100 is installed on firearm 200, ball joint or cylinder head 135 of ball head screw or cylinder head screw 130 may be pivotably disposed between lower receiver 210 of firearm 200 and socket 115 of upper portion 110. Moreover, a tip of a distal end of ball head screw or cylinder head screw 130 opposite ball joint or cylinder head 135 may be configured to receive a hex key (also known as an Allen key or Allen wrench) such that ball head screw or cylinder head screw 130 is rotatable by the hex key to vary the angle between the longitudinal axis of lower portion 120 and the longitudinal axis of the barrel of firearm 200. Alternatively, the tip of the distal end of ball head screw or cylinder head screw 130 opposite ball joint or cylinder head 135 may be configured to receive a flathead or Phillips screwdriver to rotate ball head screw or cylinder head screw 130 to vary the angle between the longitudinal axis of lower portion 120 and the longitudinal axis of the barrel of firearm 200.

Under a proposed design, upper portion 110 may be configured with a through hole such that, when the grip of device 100 is installed on the receiver portion (e.g., lower receiver 210) of firearm 200, upper portion 110 may be secured to the receiver portion by a pistol grip screw 250 that traverses the through hole and is threaded into the receiver portion. For instance, as shown in FIG. 4 and FIG. 5, upper portion 110 (and hence device 100) is secured to lower receiver 210 by pistol grip screw 250. Alternatively, upper portion 110 may be secured to the receiver portion of firearm 200 by other means. In other words, while in FIG. 4 and FIG. 5 it is shown that a pistol grip screw 250 is used to secure upper portion 110 may be secured to the receiver portion of firearm 200, in various implementations, different means (e.g., different screws, nut(s)/bolt(s), fastener(s) or mechanical device(s)) may be utilized to achieve the same purpose. For instance, on a CZ EVO, the pistol grip is typically secured to the receiver portion of the CZ EVO by one or more screws on the left and right side of the pistol grip. Thus, in implementing the proposed designs of the present disclosure on a CZ EVO, upper portion 110 would have a respective through hole on each of its left and right sides for a corresponding securing screw to secure upper portion 110 onto the receiver portion of the CZ EVO.

Advantageously, by using a tool such as a hex key/Allen wrench or a flathead/Phillips screwdriver, a user of firearm 200 may rotate ball head screw or cylinder head screw 130 to change the amount (and hence a longitudinal movement) of a threaded portion of ball head screw or cylinder head screw 130 that is received in threaded holder 125 of lower portion 120. As ball joint or cylinder head 135 of ball head screw or cylinder head screw 130 is pivotably received in socket 115 and thus sandwiched between upper portion 110 and lower receiver 210 of firearm 200, this longitudinal movement of ball head screw or cylinder head screw 130 relative to threaded holder 125 (and hence lower portion 120) would result in an angular movement or pivot of lower portion 120 around hinge 160 (or hinge pin 140) to result in a change in the angle between the longitudinal axis of lower portion 120 and the longitudinal axis of the barrel of firearm 200 to suit particular needs of the user.

It is noteworthy that the dimensions of various components of the proposed design may be adjusted to suit actual implementations. For instance, the overall size may be enlarged for implementation on a firearm of the AR10 platform (e.g., one chambered in 308 Winchester or 7.62×51 mm NATO) or a relatively larger platform. Similarly, the overall style may be changed. Likewise, the overall size may be reduced for implementation on a firearm of the AR15 platform (e.g., one chambered in .223 Remington or 5.56×54 mm NATO) or a relatively smaller platform. It is further noteworthy that each component of device 100 may be made of a suitable material (e.g., a suitable metal such as steel, aluminum or alloy) with appropriate mechanical properties such as sufficient strengths and/or hardness to withstand vibrations caused by firing of ammunition cartridges.

It is also noteworthy that, device 100 (as well as any derivative and/or variation thereof) may be implemented on other types of firearms such as, for example and without limitation, rifles, carbines, shotguns and/or pistols that are not based on the AR platform, AK platform or another platform (such as the CZ EVO).

It is further noteworthy that term "AR platform" herein refers to firearms based on the AR15 platform and the AR10 platform, as well as any variation and derivative thereof, and include AR15-styled and AR10-styled firearms, including rifles, carbines, pistols and shotguns. A firearm based on an AR platform may be chambered in one of a plethora of calibers. Some of the more popular calibers include such as, for example and without limitation, 0.223 Remington, 5.56×54 mm NATO, 0.224 Valkyrie, 300 AAC Blackout, 7.62×39 mm, 458 SOCOM, 6.5 mm Grendel, 6.8 mm Remington SPC, 308 Winchester and 7.62×51 mm NATO, just to name a few. Accordingly, the proposed design in accordance with the present disclosure may be implemented in any firearm based on the AR platform (whether the AR15 platform or the AR10 platform), as well as any variation and derivative thereof, in any suitable caliber.

Example Implementations

In view of the above, the proposed design of bipod grip for firearms may be implemented in many ways. For illustrative purposes and without limiting the scope of the present disclosure, a few example implementations of the proposed design are described below.

In one aspect, a device implementable on a firearm (e.g., one that is based on the AR platform, AK platform or another platform (such as the CZ EVO)) may include an adjustable multi-angle grip. The grip may include an upper portion and a lower portion. The upper portion may be configured to be coupled to a receiver portion of the firearm. The lower portion may be pivotably coupled to the upper portion via a hinge on a front side of the grip such that an angle between a longitudinal axis of the lower portion and a longitudinal axis of a barrel of the firearm is variable.

In some implementations, the adjustable multi-angle grip may further include an angle adjustment mechanism engaged with the upper portion and the lower portion such that a movement of the angle adjustment mechanism relative to the lower portion along the longitudinal axis of the lower portion may cause the angle between the longitudinal axis of the lower portion and the longitudinal axis of the barrel of the firearm to vary.

In some implementations, responsive to the angle adjustment mechanism being rotated around the longitudinal axis of the lower portion in a first direction, the angle between the longitudinal axis of the lower portion and the longitudinal axis of the barrel of the firearm may decrease. Additionally, responsive to the angle adjustment mechanism being rotated around the longitudinal axis of the lower portion in a second direction opposite the first direction, the angle between the longitudinal axis of the lower portion and the longitudinal axis of the barrel of the firearm may increase.

In some implementations, the angle adjustment mechanism may include a ball head screw or cylinder head screw insertable into a threaded holder of the lower portion by traversing through the upper portion with a ball joint or cylinder head of the ball head screw or cylinder head screw received in a socket of the upper portion.

In some implementations, in operation: (a) responsive to the ball head screw or cylinder head screw being tightened and further received in the threaded holder of the lower portion, the lower portion may pivot in a first direction to expose less of a back side of the upper portion, and (b) responsive to the ball head screw or cylinder head screw being loosened and less received in the threaded holder of the lower portion, the lower portion may pivot in a second direction to expose more of the back side of the upper portion.

In some implementations, the threaded holder of the lower portion may include a threaded through hole along the longitudinal axis of the lower portion.

In some implementations, the ball joint or cylinder head of the ball head screw or cylinder head screw may be pivotably disposed between the receiver portion of the firearm and the socket of the upper portion.

In some implementations, a tip of a distal end of the ball head screw or cylinder head screw opposite the ball joint or cylinder head may be configured to receive a hex key such that the ball head screw or cylinder head screw is rotatable by the hex key to vary the angle between the longitudinal axis of the lower portion and the longitudinal axis of the barrel of the firearm.

In some implementations, the hinge may be adjacent a trigger guard of the firearm.

In some implementations, the upper portion may be configured with a through hole such that, when the grip is installed on the receiver portion of the firearm, the upper portion is secured to the receiver portion by a pistol grip screw that traverses the through hole and is threaded into the receiver portion.

In one aspect, a device implementable on a firearm (e.g., one that is based on the AR platform, AK platform or another platform (such as the CZ EVO)) may include an adjustable multi-angle grip. The grip may include an upper portion, a lower portion and a ball head screw or cylinder head screw. The upper portion may be configured to be coupled to a receiver portion of the firearm. The lower portion may be pivotably coupled to the upper portion via a hinge on a front side of the grip adjacent a trigger guard of the firearm. The ball head screw or cylinder head screw may be insertable into a threaded holder of the lower portion by traversing through the upper portion with a ball joint or cylinder head of the ball head screw or cylinder head screw received in a socket of the upper portion.

In some implementations, in operation: (a) responsive to the ball head screw or cylinder head screw being tightened and further received in the threaded holder of the lower portion, the lower portion may pivot in a first direction to expose less of a back side of the upper portion, and (b) responsive to the ball head screw or cylinder head screw being loosened and less received in the threaded holder of the lower portion, the lower portion may pivot in a second direction to expose more of the back side of the upper portion.

In some implementations, the threaded holder of the lower portion may include a threaded through hole along a longitudinal axis of the lower portion.

In some implementations, the ball joint or cylinder head of the ball head screw or cylinder head screw may be pivotably disposed between the receiver portion of the firearm and the socket of the upper portion.

In some implementations, a tip of a distal end of the ball head screw or cylinder head screw opposite the ball joint or cylinder head may be configured to receive a hex key such that the ball head screw or cylinder head screw is rotatable by the hex key to vary the angle between the longitudinal axis of the lower portion and the longitudinal axis of the barrel of the firearm.

In some implementations, the upper portion may be configured with a through hole such that, when the grip is installed on the receiver portion of the firearm, the upper portion is secured to the receiver portion by a pistol grip screw that traverses the through hole and is threaded into the receiver portion.

In one aspect, a device implementable on a firearm (e.g., one that is based on the AR platform, AK platform or another platform (such as the CZ EVO)) may include an adjustable multi-angle grip. The grip may include an upper portion, a lower portion and an angle adjustment mechanism. The upper portion may be configured to be coupled to a receiver portion of the firearm. The lower portion may be pivotably coupled to the upper portion via a hinge on a front side of the grip and adjacent a trigger guard of the firearm such that an angle between a longitudinal axis of the lower portion and a longitudinal axis of a barrel of the firearm is variable. The angle adjustment mechanism may be engaged with the upper portion and the lower portion such that a movement of the angle adjustment mechanism relative to the lower portion along the longitudinal axis of the lower portion may cause the angle between the longitudinal axis of the lower portion and the longitudinal axis of the barrel of the firearm to vary.

In some implementations, responsive to the angle adjustment mechanism being rotated around the longitudinal axis of the lower portion in a first direction, the angle between the longitudinal axis of the lower portion and the longitudinal axis of the barrel of the firearm may decrease. Additionally, responsive to the angle adjustment mechanism being rotated around the longitudinal axis of the lower portion in a second direction opposite the first direction, the angle between the longitudinal axis of the lower portion and the longitudinal axis of the barrel of the firearm may increase.

In some implementations, the angle adjustment mechanism may include a ball head screw or cylinder head screw insertable into a threaded holder of the lower portion by traversing through the upper portion with a ball joint or cylinder head of the ball head screw or cylinder head screw received in a socket of the upper portion.

In some implementations, in operation: (a) responsive to the ball head screw or cylinder head screw being tightened and further received in the threaded holder of the lower portion, the lower portion may pivot in a first direction to expose less of a back side of the upper portion, and (b) responsive to the ball head screw or cylinder head screw being loosened and less received in the threaded holder of the lower portion, the lower portion may pivot in a second direction to expose more of the back side of the upper portion.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

an adjustable multi-angle grip comprising:

an upper portion configured to be coupled to a receiver portion of the firearm; and a lower portion pivotably coupled to the upper portion via a hinge on a front side of the grip such that an angle between a longitudinal axis of the lower portion and a longitudinal axis of a barrel of the firearm is variable.

2. The device of claim 1, wherein the adjustable multi-angle grip further comprises:

an angle adjustment mechanism engaged with the upper portion and the lower portion such that a movement of the angle adjustment mechanism relative to the lower portion along the longitudinal axis of the lower portion causes the angle between the longitudinal axis of the lower portion and the longitudinal axis of the barrel of the firearm to vary.

3. The device of claim 2, wherein:

responsive to the angle adjustment mechanism being rotated around the longitudinal axis of the lower portion in a first direction, the angle between the longitudinal axis of the lower portion and the longitudinal axis of the barrel of the firearm decreases; and responsive to the angle adjustment mechanism being rotated around the longitudinal axis of the lower portion in a second direction opposite the first direction, the angle between the longitudinal axis of the lower portion and the longitudinal axis of the barrel of the firearm increases.

4. The device of claim 2, wherein the angle adjustment mechanism comprises a ball head screw or cylinder head screw insertable into a threaded holder of the lower portion by traversing through the upper portion with a ball joint or cylinder head of the ball head screw or cylinder head screw received in a socket of the upper portion.

5. The device of claim 4, wherein, in operation:

responsive to the ball head screw or cylinder head screw being tightened and further received in the threaded holder of the lower portion, the lower portion pivots in a first direction to expose less of a back side of the upper portion, and responsive to the ball head screw or cylinder head screw being loosened and less received in the threaded holder of the lower portion, the lower portion pivots in a second direction to expose more of the back side of the upper portion.

6. The device of claim 4, wherein the threaded holder of the lower portion comprises a threaded through hole along the longitudinal axis of the lower portion.

7. The device of claim 4, wherein the ball joint or cylinder head of the ball head screw or cylinder head screw is pivotably disposed between the receiver portion of the firearm and the socket of the upper portion.

8. The device of claim 4, wherein a tip of a distal end of the ball head screw or cylinder head screw opposite the ball joint or cylinder head is configured to receive a hex key such that the ball head screw or cylinder head screw is rotatable by the hex key to vary the angle between the longitudinal axis of the lower portion and the longitudinal axis of the barrel of the firearm.

9. The device of claim 1, wherein the hinge is adjacent a trigger guard of the firearm.

10. The device of claim 1, wherein the upper portion is configured with a through hole such that, when the grip is installed on the receiver portion of the firearm, the upper portion is secured to the receiver portion by a pistol grip screw that traverses the through hole and is threaded into the receiver portion.

11. A device implementable on a firearm, comprising:

an adjustable multi-angle grip comprising:

an upper portion configured to be coupled to a receiver portion of the firearm;

a lower portion pivotably coupled to the upper portion via a hinge on a front side of the grip adjacent a trigger guard of the firearm; and a ball head screw or cylinder head screw insertable into a threaded holder of the lower portion by traversing through the upper portion with a ball joint or cylinder head of the ball head screw or cylinder head screw received in a socket of the upper portion.

12. The device of claim 11, wherein, in operation:

responsive to the ball head screw or cylinder head screw being tightened and further received in the threaded holder of the lower portion, the lower portion pivots in a first direction to expose less of a back side of the upper portion, and responsive to the ball head screw or cylinder head screw being loosened and less received in the threaded holder of the lower portion, the lower portion pivots in a second direction to expose more of the back side of the upper portion.

13. The device of claim 11, wherein the threaded holder of the lower portion comprises a threaded through hole along a longitudinal axis of the lower portion.

14. The device of claim 11, wherein the ball joint cylinder head of the ball head screw or cylinder head screw is pivotably disposed between the receiver portion of the firearm and the socket of the upper portion.

15. The device of claim 11, wherein a tip of a distal end of the ball head screw or cylinder head screw opposite the ball joint or cylinder head is configured to receive a hex key such that the ball head screw or cylinder head screw is rotatable by the hex key to vary the angle between the longitudinal axis of the lower portion and the longitudinal axis of the barrel of the firearm.

16. The device of claim 11, wherein the upper portion is configured with a through hole such that, when the grip is installed on the receiver portion of the firearm, the upper portion is secured to the receiver portion by a pistol grip screw that traverses the through hole and is threaded into the receiver portion.

17. A device implementable on a firearm, comprising:

an adjustable multi-angle grip comprising:

an upper portion configured to be coupled to a receiver portion of the firearm;

a lower portion pivotably coupled to the upper portion via a hinge on a front side of the grip and adjacent a trigger guard of the firearm such that an angle between a longitudinal axis of the lower portion and a longitudinal axis of a barrel of the firearm is variable; and an angle adjustment mechanism engaged with the upper portion and the lower portion such that a movement of the angle adjustment mechanism relative to the lower portion along the longitudinal axis of the lower portion causes the angle between the longitudinal axis of the lower portion and the longitudinal axis of the barrel of the firearm to vary.

18. The device of claim 17, wherein:

responsive to the angle adjustment mechanism being rotated around the longitudinal axis of the lower portion in a first direction, the angle between the longitudinal axis of the lower portion and the longitudinal axis of the barrel of the firearm decreases; and responsive to the angle adjustment mechanism being rotated around the longitudinal axis of the lower portion in a second direction opposite the first direction, the angle between the longitudinal axis of the lower portion and the longitudinal axis of the barrel of the firearm increases.

19. The device of claim 17, wherein the angle adjustment mechanism comprises a ball head screw or cylinder head screw insertable into a threaded holder of the lower portion by traversing through the upper portion with a ball joint or cylinder head of the ball head screw or cylinder head screw received in a socket of the upper portion.

20. The device of claim 19, wherein, in operation:

responsive to the ball head screw or cylinder head screw being tightened and further received in the threaded holder of the lower portion, the lower portion pivots in a first direction to expose less of a back side of the upper portion, and responsive to the ball head screw or cylinder head screw being loosened and less received in the threaded holder of the lower portion, the lower portion pivots in a second direction to expose more of the back side of the upper portion.

* * * * *